United States Patent [19]

Gallagher

[11] 4,330,105

[45] May 18, 1982

[54] CRANE TYPE LIFTING ASSEMBLY FOR HEAVY LOADS

[75] Inventor: Roger W. Gallagher, Scottsdale, Ariz.

[73] Assignee: Reliance Truck Company, Phoenix, Ariz.

[21] Appl. No.: 139,101

[22] Filed: Apr. 10, 1980

[51] Int. Cl.[3] ..... B66F 7/14

[52] U.S. Cl. ..... 254/89 R

[58] Field of Search ..... 254/89 R, 98, 7 R, 7 B, 254/7 C, 103; 269/73; 187/24–25, 8.54, 8.91; 74/424.8 R

[56] References Cited

U.S. PATENT DOCUMENTS 158,976 1/1875 Pfautz ..... 187/24

4,124,191 11/1978 Hofmann ..... 254/89 R

FOREIGN PATENT DOCUMENTS 1283483 7/1972 United Kingdom ..... 254/98 R

*Primary Examiner*—Robert C. Watson

*Attorney, Agent, or Firm*—Warren F. B. Lindsley

[57] ABSTRACT

A crane type lifting assembly for heavy loads employing two pairs of spacedly positioned frame mounted screws bridged by a balanced yoke type beam with each end of the beam guided between the screws.

10 Claims, 7 Drawing Figures

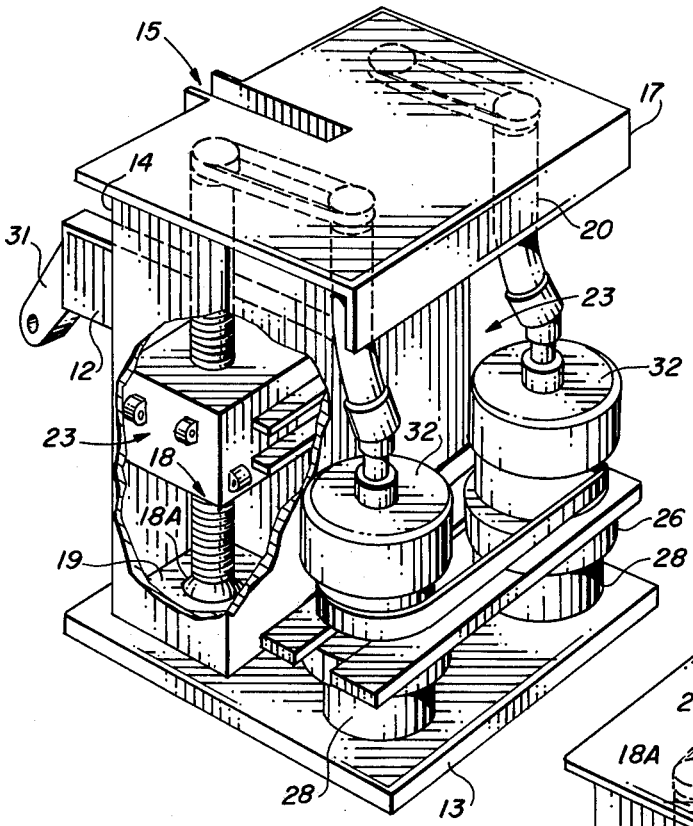
FIG. 5
FIG. 6
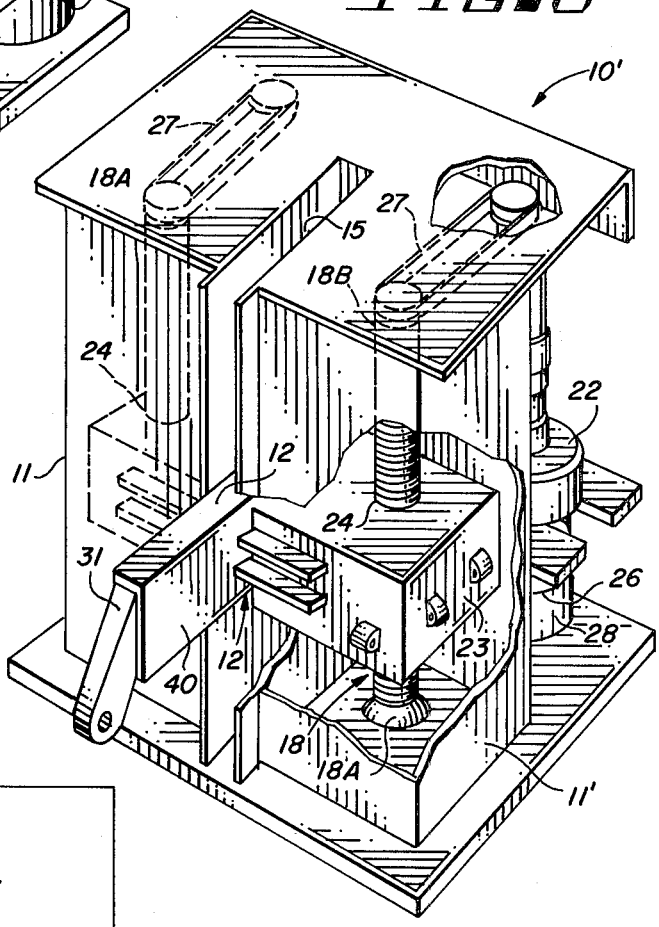
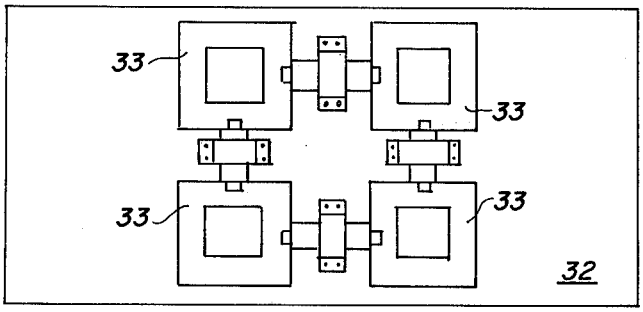
FIG. 7

CRANE TYPE LIFTING ASSEMBLY FOR HEAVY LOADS

BACKGROUND OF THE INVENTION

This invention relates to an assembly and method of lifting heavy loads by utilizing two pairs of spacedly positioned screws bridged by a balanced yoke type beam.

FIELD OF THE INVENTION

Cranes have been built for a variety of uses and have been individual in character and construction. One such crane is called the jacking frame which is a fixed crane intended to quickly load and unload very heavy objects from railroad cars or the like to temporary storage or working positons. Most of these structure lifting and moving loads over 10 to 15 tons have been complicated and are operated by steam, electricity or fluid power of one type or another and involve lateral forces which at times become dangerous.

DESCRIPTION OF THE PRIOR ART

Previous mechanisms have used a single screw at each load point with the screws acting as the guide and being subjected to dangerous lateral forces.

Other types of structures such as the fluid actuated jacking frame disclosed in U.S. Pat. No. 3,784,029 employing an inverted U-shaped bridge-like structure actuated by two rams providing step by step vertical travel while periodically repositioning themselves on the bridge like structure have been used. None of the known assemblies have employed a unitized heavy load lifting assembly which limits or greatly reduces the eccentric reaction forces encountered by lifting mechanisms.

SUMMARY OF THE INVENTION

In accordance with the invention claimed, a new and improved method and assembly is provided which can lift heavy loads by the use of two pairs of spacedly positioned frame mounted tension screw means wherein the frames form guides for the ends of a lifting beam.

It is, therefore, one object of this invention to provide a new and improved hoisting frame.

Another object of this invention is to provide a lifting assembly employing a pair of frame mounted tension screws connected together by a saddle positioned within a guiding slot of the frame which slot controls lateral forces applied to the screws.

A further object of this invention is to provide a pair of frame mounted screws or hydraulic actuators which may be utilized with two or more similar structures interconnected by a balanced yoke type beam for removing or controlling eccentric reaction forces encountered by the threads of the screws.

A still further object of this invention is to provide a new and improved lifting assembly for heavy loads employing at least one pair of frame mounted screws under tension syncronously driven by motorized gears causing vertical travel of an associated lift beam connected between a pair of screws.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWING

The present invention may be more readily described by reference to the accompanying drawings in which:

FIG. 5 is a perspective view partially in section of a modification of the load lifting assembly shown in FIGS. 1–4;

FIG. 6 is a perspective view partially in section of the opposite sides of the structure shown in FIG. 5; and FIG. 7 is a top view of an X–Y positioner for a lifting assembly.

DESCRIPTION OF THE PREFERRED EMBODIMENT

Figure 1:
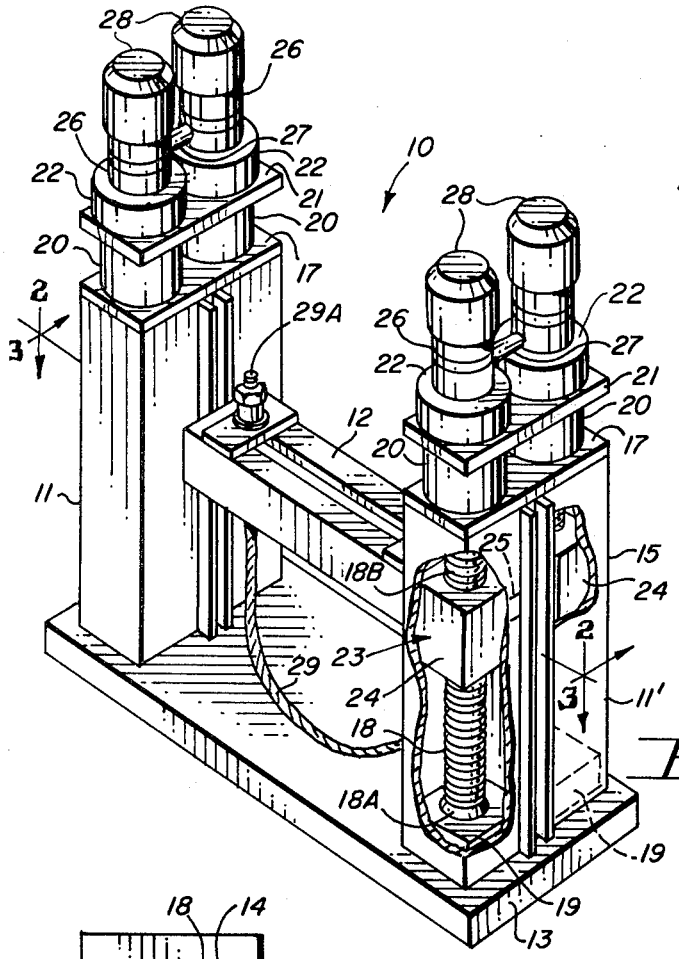
FIG. 1 is a perspective view of a heavy load lifting assembly employing two pairs of frame mounted tension screws bridged by a lifting beam and employing the invention.
Figure 4:
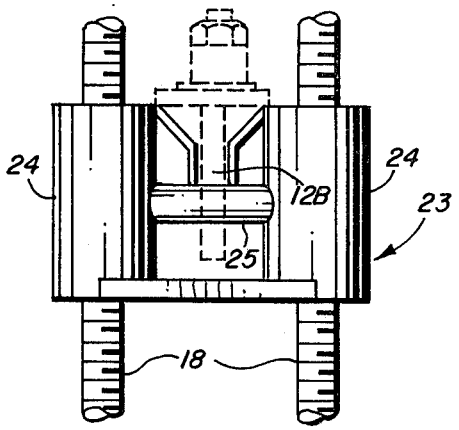
FIG. 4 is a cross-sectional view of FIG. 2 taken along the line 4—4.
Figure 2:
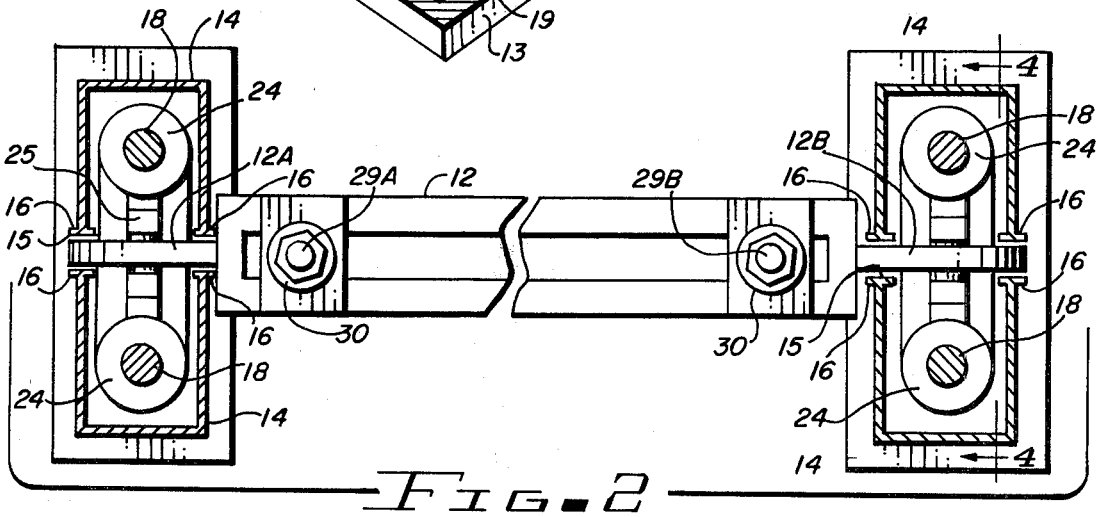
FIG. 2 is a cross-sectional view of FIG. 1 taken along the line 2—2.
Figure 3:
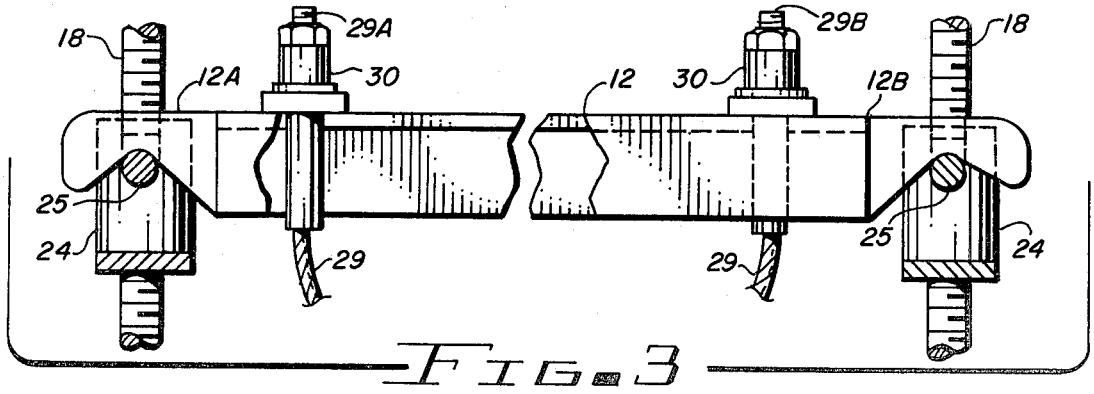
FIG. 3 is a cross-sectional view of FIG. 1 taken along the line 3—3.

Referring more particularly to the drawing by characters of reference, FIGS. 1–4 disclose a heavy load lifting assembly or mechanism 10 comprising a pair of vertical columns or tower assemblies 11, 11' and a horizontally positioned cross beam or yoke assembly 12. The yoke assembly 12 joins the tower assemblies together for maintaining a parallel relationship thereof.

Each of the tower assemblies 11, 11' is preferably mounted on a common base or concrete slab 13 over which the lifting assembly is erected and comprises an elongated U-shape frame 14 providing a slot 15 between their juxtapositioned ends 16 in which the ends 12A and 12B of the cross beam 12 extend. Frames 14 are juxtapositoned in pairs with a common end of each pair resting on the top surface of slab 13, as shown in FIG. 1, and substantially vertical thereto. A support plate 17 is placed across the other ends of each pair of frames 14 and bridges the space therebetween for holding each frame of each tower in the spaced arrangement shown so as to define the slotted configuration 15 therebetween.

Each tower assembly comprises a pair of tension screws 18, one end 18A of which is journaled in a guide bearing 19 and the other ends 18B of which are journaled in thrust bearings 20 which carries the load of the assembly mounted on top of support plates 17. The upper ends 18B of screws 18 extend through a second support plate 21 parallelly arranged to support plate 17 and into mechanical connection with gear reduction means 22.

Each screw assembly of a given pair of screws in one of the towers 11, 11' is interconnected with an associated screw 18 by a floating nut assembly 23 which moves up and down along a given pair of screws in one of the towers in screw bridging arrangment. The nut assembly comprises a pair of nuts 24, one floatingly mounted in side by side arrangement on each screw 18 and interconnected by means 25 called a load saddle.

The gear reduction means are each driven by an electric motor 26 synchronized in pairs in a known manner and connected by an interconnecting means such as a belt or shaft 27. The top end of each motor is provided with a suitable braking mechanism 28 which may function in an electric, pneumatic or hydraulic mode interconnected with the shaft of the motors for braking purposes.

In accordance with the invention claimed, each of the ends 12A and 12B of the cross beam 12 is provided with a hook or yoke which fits over and hooks partially around the shaft interconnecting nuts 24 herein called the load saddle 25. This yoke is positioned in slot 15 formed between the ends 16 of the U-shaped frames 14.

It should be noted that the cross beam 12 is shown as comprising a rectangular configuration slotted along a given portion of its length for fastening at points therealong the free ends 29A and 29B of a sling 29 by suitable sling anchors 30. The sling 29 is utilized in the usual manner to surround or fasten to a load for raising or lowering by the lifting assembly 10.

In accordance with the invention claimed, a unitary heavy load lifting assembly is disclosed comprising a paired screw and frame assembly which can be used individually or in a combination of two or more with a balanced beam assembly. The guide slot disclosed in the frame assemblies, two of which form a tower assembly, removes or absorbs the eccentric reaction forces from the threads of the screws. Further, the screws utilized for moving the load up or down in a vertical direction are under tension at all times thereby utilizing their strongest physical characteristics.

These screws are utilized in pairs and support therebetween a vertically movable lifting beam which are supported on the screws by a pair of floating nuts each movable by the screws synchronously driven by a system of motorized gears. The ends of the lifting beams are guided in a slot formed by the frames surrounding the screws such that lateral and eccentric forces applied to the threads of the screws by the load being supported and moved are absorbed or greatly reduced by the periphery of the slots 15 formed by the frames.

In order to raise or lower the load cross beam 12, the electric motors 26 are energized by controls (not shown) which are synchronized in pairs in each tower assembly to move the floating nut assemblies 23 up or down along the length of the associated screws 18. If desired, the motors in one or more towers may be synchronized together to lift a load keeping the cross beam in a horizontal position. At a given point, the electric motors are de-energized and the brakes 28 applied to keep the load in its chosen position.

FIGS. 5 and 6 disclose a modification of the lifting assembly shown in FIGS. 1–4 wherein like parts are given the same reference characters even though the physical arrangement of these parts are different.

As shown in FIGS. 5 and 6, a lifting ear 31 may be attached to or form a part of the cross beam 12 so that it may engage the object to be lifted in a well known manner.

FIG. 7 discloses a load positioning platform 32 for supporting the lifting assemblies 10, 10' which is provided with means for rotating slightly or positioning the jack or lifting assembly in an X, Y grid manner. This platform makes it possible to accurately position the lifting assembly relative to the load or accurately position the load after elevation in an exact spot.

The load positioner comprises a gear motor drive ball screw 33 located at each of the four corners of platform 32 at the base of the lifting machinanism, as shown in FIG. 7. If desired, this gear motor drive ball screw may be replaced by hydraulically actuated cylinders. Each gear motor or hydraulic cylinder may be actuated individually or in combination to move in an X, Y grid pattern or in a rotational manner, the lifting assembly.

Thus, an effective method and heavy duty dual screw lifting apparatus are provided for liffting heavy loads which reduces or eliminates the eccentric forces applied to the screws in accordance with the stated objects of the invention.

Although but two embodiments of the invention have been illustrated and described, it will be apparent to those skilled in the art that various changes and modifications may be made therein without departing from the spirit of the invention or from the scope of the appended claims.

What is claimed is:

1. A lifting mechanism for cargo comprising:

a verticaly positioned frame defining a slot extending longitudinally thereof, a pair of screws juxtapositioned in said frame to extend longitudinally thereof one on each side of said slot, each of said screws being journaled on said frame to rotate in tension under load, a nut threadedly associated with each screw for movement longitudinally thereof, saddle means for interconnecting each nut, motor means mounted on said frame one for each screw, gear reduction means interconnecting each motor means with each shaft, means for synchronizingly interconnecting each of said motor means for operating both screws in unison for moving said nuts along their respective screws in side by side arrangement, and a lift beam, said lift beam comprising attachment means formed at one end thereof for extending through said slot and resting on said saddle means, said slot closely confining said attachment means to prevent substantial external movement thereof, whereby movement of each of the nuts along its respective screw moves the attachment means of said lift beams up or down within said slot along said frame.

2. The lifting mechanism set forth in claim 1 wherein:

said attachment means comprises a yoke formed at one end thereof for extending through said slot and hooking over said saddle means.

3. The lifting mechanism set forth in claim 1 wherein:

each of said motor means comprises an electric motor.

4. The lifting mechanism set forth in claim 1 wherein:

each screw is journaled in a thrust bearing at the top of the vertically positioned frame and in a guide bearing at the base of said frame.

5. The lifting mechanism set forth in claim 2 wherein:

said yoke comprises an arcuate surface which surrounds at least a part of the top of said saddle means.

6. The lifting mechanism set forth in claim 1 wherein:

a second lifting mechanism identical to the lifting mechanism of claim 1 is spacedly positioned thereto, and said lift beam comprises a yoke at the other end of the lift beam for extending through the slot of the second frame for hooking over the saddle means of the second lifting mechanism.

7. A lifting mechanism set forth in claim 1 wherein:

each of the screws comprises a threaded bolt.

8. A lifting mechanism for cargo comprising:

a pair of juxtapositioned substantially vertically arranged frames each defining a slot extending longitudinally thereof.

two pairs of screws, each pair being mounted in a different one of said frames longitudinally thereof, one screw of each pair being on each side of the slot in the associated frame, each of said screws being journaled in its frame to rotate in tension under load, a nut threadedly associated with each screw for movement longitudinally thereof, saddle means for interconnecting the nuts in their common frame, motor means mounted on each of the frames one for each screw, gear reduction means one interconnecting each motor means with each shaft, means for synchronizingly interconnecting each of the motor means in each of said frames for operating both screws of a given frame in unison for moving the associated nuts along their respective screws in side by side arrangement, a lift beam, said lift beam having a yoke formed at each end thereof for extending through the slot in the associated frame and hooking over the saddle means in the associated frame, the slots of each of said frames closely confining the associated yoke to prevent substantial lateral movement thereof, whereby movement of the nuts in each of the frames along its respective screws moves the associated yoke end of the lift beam up or down within the slot of an associated frame.

9. The lifting mechanism set forth in claim 8 wherein: each of the screws comprises a threaded bolt.

10. The lifting mechanism set forth in claim 8 in further combination with:

a load positioning mechanism mounted below each of said frames for moving the lifting mechanism for accurately lowering and positioning its cargo.

* * * * *